US010026574B2

(12) United States Patent
Lenz et al.

(10) Patent No.: US 10,026,574 B2
(45) Date of Patent: Jul. 17, 2018

(54) MULTI-LOAD DRIVE CIRCUIT

(71) Applicant: Infineon Technologies AG, Neubiberg (DE)

(72) Inventors: Michael Lenz, Zorneding (DE); Rolf-Peter Goeser, Munich (DE); Cristi-Stefan Zegheru, Bucharest (RO)

(73) Assignee: Infineon Technologies AG, Neubiberg (DE)

( * ) Notice: Subject to any disclaimer, the term of this patent is extended or adjusted under 35 U.S.C. 154(b) by 1022 days.

(21) Appl. No.: 13/846,349

(22) Filed: Mar. 18, 2013

(65) Prior Publication Data

US 2014/0265570 A1 Sep. 18, 2014

(51) Int. Cl.
*H01H 47/32* (2006.01)

(52) U.S. Cl.
CPC ..... *H01H 47/32* (2013.01); *Y10T 307/352* (2015.04); *Y10T 307/406* (2015.04)

(58) Field of Classification Search
CPC ..... H02J 4/00; Y10T 307/352; Y10T 307/406
USPC ..... 307/31, 24
See application file for complete search history.

(56) References Cited

U.S. PATENT DOCUMENTS 6,329,892 B1 * 12/2001 Wohlfarth ..... H01H 51/28 335/151
7,834,678 B2 11/2010 Niessen et al.
7,924,188 B2 4/2011 Tokumara et al.
8,242,710 B2 8/2012 Radermacher et al.
8,723,444 B2 5/2014 Pansier
2003/0209994 A1 * 11/2003 Kerenyi, Jr. ..... H02M 3/155 315/219
2006/0071557 A1 * 4/2006 Osawa ..... B60L 3/0046 307/10.1
2009/0284889 A1 11/2009 Lenz
2010/0007536 A1 * 1/2010 Tokumaru ..... H03K 17/223 341/135
2013/0201594 A1 * 8/2013 Lin ..... H01H 47/12 361/191
2014/0042907 A1 2/2014 Cheng et al.

FOREIGN PATENT DOCUMENTS

CN 101202030 A 6/2008
CN 101578561 A 11/2009
CN 101690397 A 3/2010
CN 102651939 A 8/2012
CN 102841624 A 12/2012
DE 10353224 A1 5/2004

* cited by examiner

*Primary Examiner* — Rexford Barnie
*Assistant Examiner* — Thai Tran
(74) *Attorney, Agent, or Firm* — Slater Matsil, LLP

(57) ABSTRACT

A circuit arrangement includes a first number of loads connected in series. Each of a second number of drive units is coupled to at least one of the first number of loads, and is configured to assume a first operation state or a second operation state. A current source circuit is coupled in series with the first number of loads and is configured to control a load current.

21 Claims, 8 Drawing Sheets

MULTI-LOAD DRIVE CIRCUIT

TECHNICAL FIELD

Embodiments of the present invention relate to a circuit arrangement with a plurality of loads such as relays and with a drive circuit for driving the loads.

BACKGROUND

A relay is an electrically controllable switch device that includes a mechanical switch and a coil configured to switch the mechanical switch. The relay can be actuated by driving a pull-in current through the coil. This current through the coil causes a magnetic field which, in turn, causes the mechanical switch to change its switching state (e.g., from an off-state to an on-state). In order to actuate the relay, the pull-in current is required to flow for a defined time period that allows establishment of a sufficient magnetic field. After the relay has been actuated, a current lower than the pull-in current is required to keep the relay in the actuated state.

Thus, a modern relay controller (relay driver) is configured to reduce the current through the coil from a pull-in level to a hold level lower than the pull-in level after a defined time period. This helps to reduce the power consumption of the relay controller.

There is a need to further reduce the power consumption involved in driving a relay, in particular in applications that include a plurality of relays.

SUMMARY OF THE INVENTION

A first embodiment relates to a circuit arrangement. The circuit arrangement includes a first number of loads connected in series, a second number of drive units, wherein each of the second number of drive units is coupled to at least one of the first number of loads, and is configured to assume one of a first operation state and a second operation state, and a current source circuit connected in series with the first plurality of loads and configured to control a load current.

A second embodiment relates to a drive circuit. The drive circuit includes a number of drive units, wherein each of the drive units is configured to be coupled to at least one load, and is configured to assume one of a first operation state and a second operation state. The drive circuit further includes a current source circuit connected in series with the first number of loads and configured to control a load current.

BRIEF DESCRIPTION OF THE DRAWINGS

Examples will now be explained with reference to the drawings. The drawings serve to illustrate the basic principle, so that only aspects necessary for understanding the basic principle are illustrated. The drawings are not to scale. In the drawings the same reference characters denote like features.

DETAILED DESCRIPTION OF ILLUSTRATIVE EMBODIMENTS

In the following detailed description, reference is made to the accompanying drawings. The drawings form a part of the description and by way of illustration show specific embodiments in which the invention may be practiced. It is to be understood that the features of the various embodiments described herein may be combined with each other, unless specifically noted otherwise.

Figure 1:
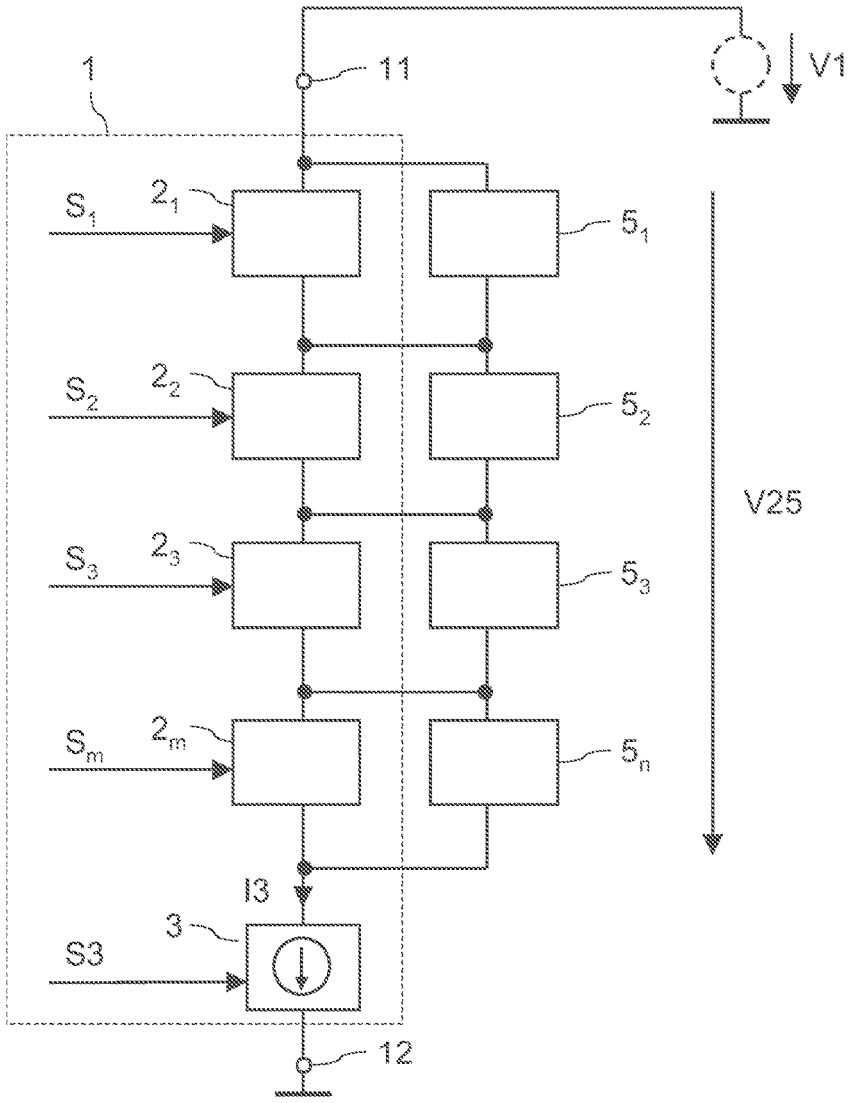
FIG. 1 illustrates an embodiment of a circuit arrangement including a first number of loads connected in series, a second number of drive units, and a current source circuit with each drive unit coupled to one of the first number of loads.

FIG. 1 illustrates a first embodiment of a circuit arrangement that includes a first number n (where n≥2) of loads $\mathbf{5}_1$-$\mathbf{5}_1$, a second number m (where m≥2) of drive units $\mathbf{2}_1$-$\mathbf{2}_m$, and a controllable current source 3. The loads $\mathbf{5}_1$-$\mathbf{5}_n$, are connected in series, and a series circuit with the loads $\mathbf{5}_1$-$\mathbf{5}_n$, is connected in series with a controllable current source 3. The series circuit with the loads $\mathbf{5}_1$-$\mathbf{5}_n$, and the current source 3 is connected between a first load terminal 11 and a second load terminal 12. These first and second load terminals 11, 12 are configured to receive a first supply voltage V1. The first supply voltage V1 can be provided by a conventional power source 6 (illustrated in dashed lines in FIG. 1) in particular by a conventional DC power source. According to one embodiment, the first supply voltage V1 is substantially fixed. The voltage level is, for example, between 10V and 50V, in particular between 20V and 40V, but could also be higher than 50V. The supply voltage V1 is, in particular, dependent on the number of loads that are desired to be driven.

According to FIG. 1, each of the drive units $\mathbf{2}_1$-$\mathbf{2}_m$ is coupled to at least one of the loads $\mathbf{5}_1$-$\mathbf{5}_n$. In particular, each of the drive units $\mathbf{2}_1$-$\mathbf{2}_m$ is connected in parallel with one of the loads $\mathbf{5}_1$-$\mathbf{5}_n$, such that the drive units $\mathbf{2}_1$-$\mathbf{2}_m$ form a further series circuit connected in series with the controllable current source 3. In the embodiment of FIG. 1, the first number n corresponds to the second number m (n=m) so that each of the drive units $\mathbf{2}_1$-$\mathbf{2}_m$ is connected in parallel with exactly one of the loads $\mathbf{5}_1$-$\mathbf{5}_n$. However, it is also possible that one drive unit is connected in parallel with a series circuit with at least two loads.

Figure 2:
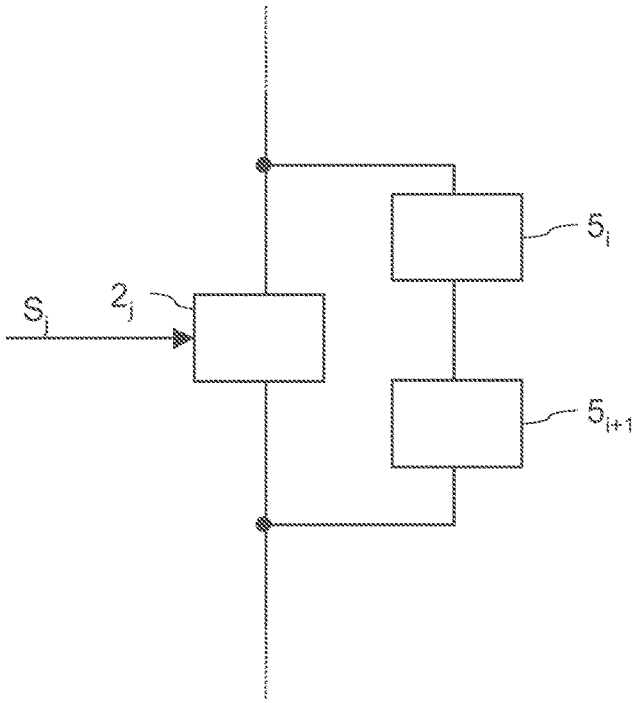
FIG. 2 illustrates one drive unit connected in parallel with a series circuit including two loads.

FIG. 2 shows one embodiment in which one drive unit $\mathbf{2}_j$ is connected in parallel with a series circuit with two loads $\mathbf{5}_i$, $\mathbf{5}_{i+1}$. In a circuit arrangement in which at least one of the drive units $2_1$-$2_m$ is connected in parallel with a series circuit with at least two of the first number of loads $5_1$-$5_n$, the second number m is smaller than the first number n (m<n).

Referring to FIG. 1, the drive units $2_1$-$2_m$ and the current source 3 are part of a drive circuit 1 that is configured to drive the individual loads $5_1$-$5_n$. In general, the current source 3 causes a load current I3 to flow between the first and second load terminals 11, 12. The individual drive units $2_1$-$2_m$ are each configured to assume one of a first operation state and a second operation state. The first operation state corresponds to a high-ohmic state, and the second operation state corresponds to a low-ohmic state. When a drive unit $2_i$, (wherein $2_i$, denotes an arbitrary one of the drive units $2_1$-$2_m$) is in the low-ohmic state it bypasses the corresponding load $5_i$, (wherein $5_i$, denotes the at least one load connected in parallel with the drive unit $2_i$) so that the load current I3 substantially flows through the drive unit Z. In this case, substantially no current flows through the load $5_i$, so that the load $5_i$ is deactivated (non-actuated). When a drive unit $2_i$ is in the high-ohmic state (the first operation state) substantially no current flows through the drive unit $2_i$, so that the load current I3 flows through the corresponding load $5_i$ and the load $5_i$ is activated (actuated). Thus, a first operation state of one drive unit $2_i$ corresponds to an activated state of the corresponding load $5_i$, while a second operation state of the drive unit $2_i$ corresponds to a deactivated state of the load $5_i$.

Referring to FIG. 1, each of the drive units $2_1$-$2_m$ receives a control signal $S_1$-$S_m$, wherein each of the control signals $S_1$-$S_m$ defines the operation state of the corresponding drive unit $2_1$-$2_m$ and, consequently, defines the operation state of the corresponding load $5_1$-$5_n$. According to one embodiment, each of the drive signals $S_1$-$S_m$ can assume one of a first signal level and second signal level, wherein the first signal level causes the corresponding drive units $2_1$-$2_m$ to be in the first operation state (high-ohmic state), while the second signal level causes the corresponding drive unit $2_1$-$2_m$ to be in the second operation state (low-ohmic state). Considering that a load $5_i$ is activated when the corresponding drive unit $2_i$ is in the first operation state, the first level of the drive signal $S_i$($S_i$ denotes the drive signal received by drive unit $2_i$) will be referred to as activation level, while the second signal level will be referred to as deactivation level.

The current source 3 is configured to control the load current I3 through the arrangement with the loads $5_1$-$5_n$ and the drive circuits $2_1$-$2_n$. According to one embodiment, the current source circuit is configured to control the load current I3 to be substantially constant.

According to a further embodiment, the current source circuit 3 is configured to vary the load current I3 such that the load current I3 increases to a first current level for a predefined time period each time one of the drive units $2_1$-$2_m$ assumes the first operation state, that is each time one of the loads $5_1$-$5_n$ is activated.

Figure 3:
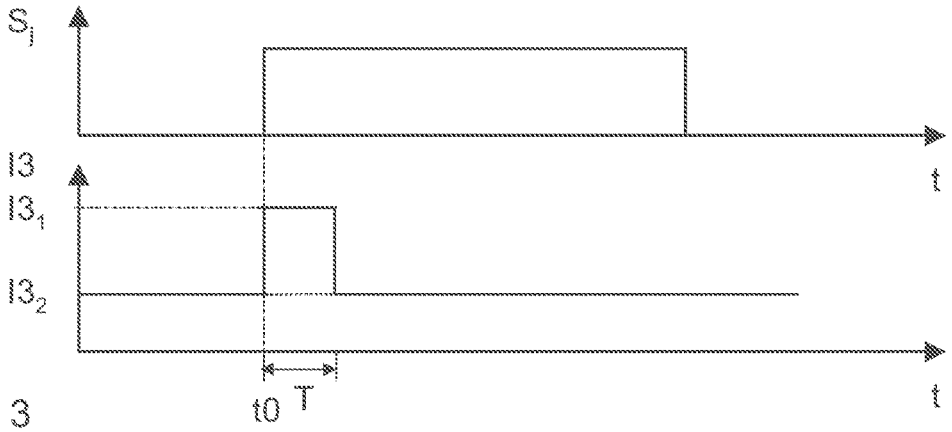
FIG. 3 shows timing diagrams illustrating the operating principle of the current source circuit dependent on an operation state of one drive unit.

FIG. 3 shows timing diagrams illustrating the operation principle of a current source circuit 3 configured to vary the load current level. A first timing diagram of FIG. 3 illustrates the operation state of one drive unit $2_i$ wherein in FIG. 3 the operation state of the drive unit $2_i$ is represented by the control signal $S_i$ received by the drive unit $2_i$. In the present embodiment, a high level (logic "1") of the control signal $S_i$ represents the first operation state, and a low level (logic "0") represents a second operation state. A second timing diagram in FIG. 3 illustrates the load current I3 generated by the current source I3.

Referring to FIG. 3, the current source 3 increases the load current I3 to a first current level $I3_1$ from a second current level $I3_2$ for a predefined time period T each time one of the drive unit changes from the second operation state to the first operation state in order to activate the corresponding load $5_i$. In FIG. 3, the drive unit $2_i$ changes from the second operation state to the first operation state at time t0 (wherein the change of the operation state is represented by a change of the signal level of the control signal $S_i$ from the deactivation level (low-level) to the activation level (high-level) in FIG. 3). In case the current source circuit 3 is configured to keep the load current I3 substantially constant, the current curve would correspond to the current curve illustrated in dotted lines in FIG. 3.

Figure 4:
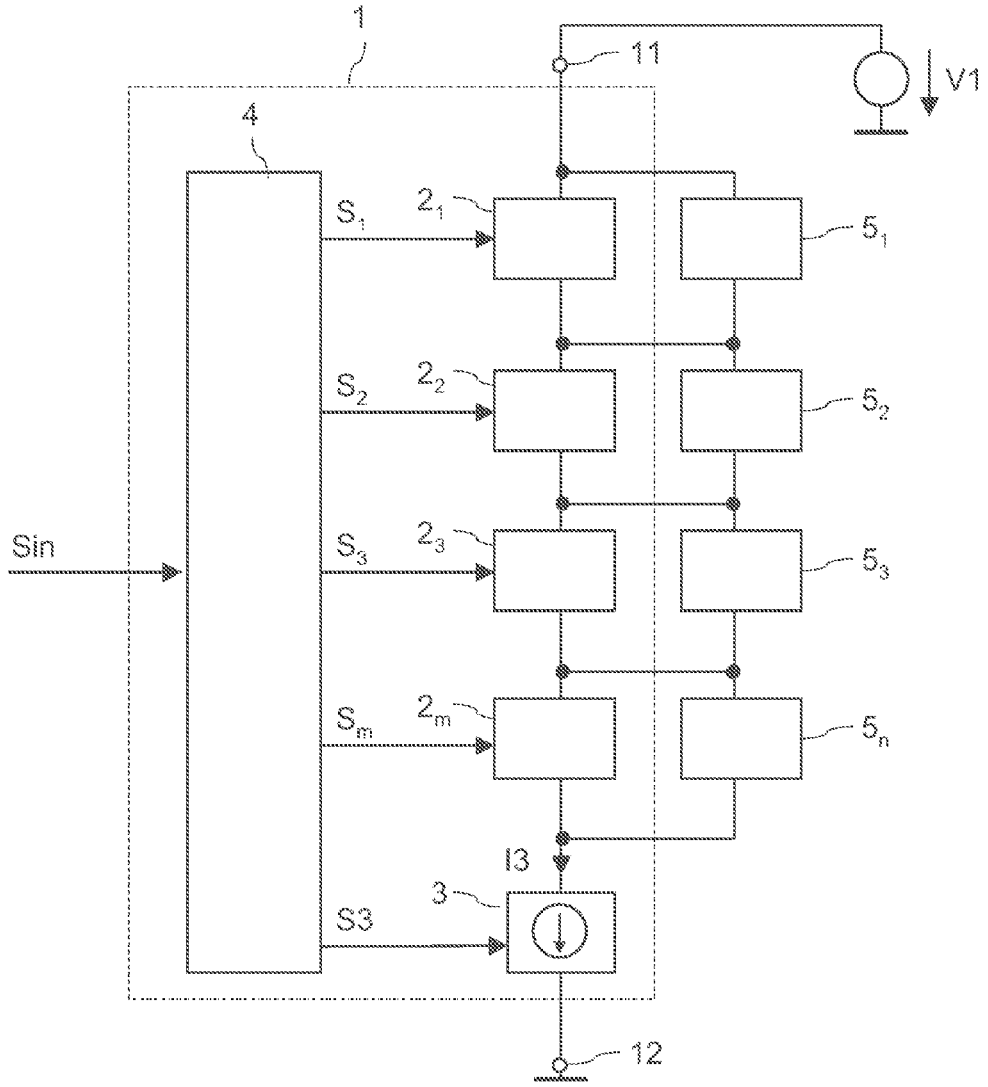
FIG. 4 illustrates the circuit arrangement of FIG. 1, further including a control circuit.

According to one embodiment illustrated in FIG. 4, the drive circuit 1 includes a control circuit 4 that receives an input signal Sin and that outputs the control signals $S_i$-$S_m$ to the individual drive units $2_1$-$2_m$, and a current source control signal S3 to the current source 3. The current source control signal S3 controls the current source 3 to generate the load current I3.

When the current source circuit 3 is configured to keep the load current I3 substantially constant, the current source control signal can be omitted, or can be configured to indicate whether at least one of the drive units $2_1$-$2_m$ is in the first operation mode. If the control signal S3 indicates that at least one of the drive units $2_1$-$2_m$ is in the first operation mode, the current source circuit 3 generates a substantially constant load current I3 (other than zero). If the control signal S3 indicates that none of the drive units is in the first operation mode, the current source circuit 3 can be deactivated, so that the load current I3 becomes zero. In this embodiment, the current source circuit generates a substantially constant load current I3 in an activated state (when at least one drive unit is in the first operation mode) and no load current (a load current I3=0) in the deactivated state.

When the current source circuit 3 is configured to vary the current level of the load current I3, the current source control signal S3 controls the current source, in the activated state, 3 to generate the load current I3 either with the second current level ($I3_2$ in FIG. 3) or with the first current level ($I3_1$ in FIG. 3). Like in the embodiment explained before, the current source 3 can be deactivated (so that I3=0) when the current source control signal S3 indicates that none of the drive units $2_1$-$2_n$ is in the first operation mode. According to one embodiment, the control circuit 4 generates the current source control signal S3 dependent on the drive unit control signals $S_1$-$S_m$ or dependent on information used to generate the drive unit control signals $S_1$-$S_m$. This information is included in the input signal Sin. This input signal Sin may be provided by a central control unit (not illustrated in FIG. 4), such as a microprocessor, that governs the operation of the individual loads $5_1$-$5_n$. The input signal Sin can be an analog signal or a digital signal and can be a signal in accordance with any conventional signal transmission protocol (like, e.g., used in automotive or industrial circuit applications). The control circuit 4 may include an interface circuit configured to receive the input signal Sin, to obtain the information included in the input signal Sin on the desired operation states of the loads $5_1$-$5_n$ and to generate the control signals $S_1$-$S_m$ dependent on this information. The current source circuit 3 then generates the load current I3 dependent on this information.

Figure 5:
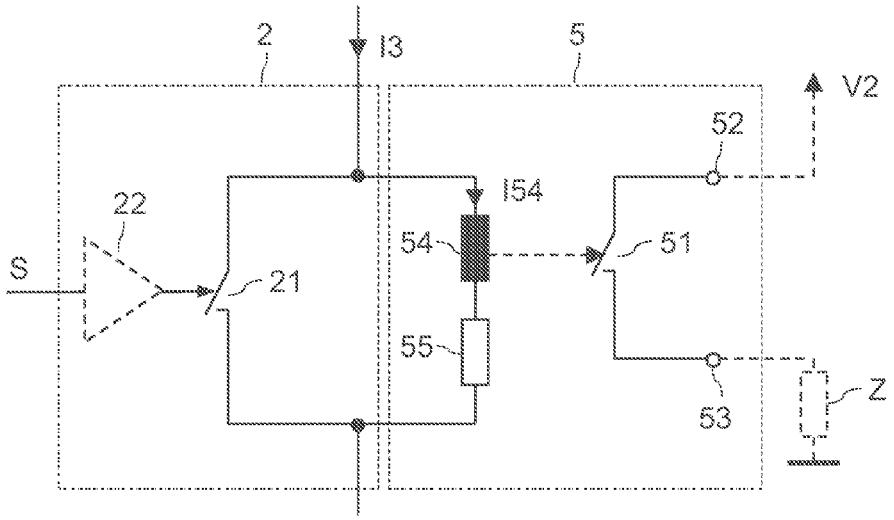
FIG. 5 illustrates one embodiment of a load including a relay and one embodiment of a corresponding drive unit.

The drive circuits 1 of FIGS. 1 and 4 that are configured to control the individual loads $5_1$-$5_n$ individually (independently), and that are configured to increase the load current I3 for a predefined time period each time one of the loads $5_1$-$5_n$ is to be activated are, particularly, useful in driving loads $5_1$-$5_n$ that each include a relay. FIG. 5 illustrates one embodiment of a load 5 including a relay. Reference character 5 in FIG. 5 denotes an arbitrary one of the loads $\mathbf{5}_1$-$\mathbf{5}_n$ explained with reference to FIGS. 1 and 4 before. Each of the loads $\mathbf{5}_1$-$\mathbf{5}_n$ can be implemented like the load 5 of FIG. 5. However, it is also possible to implement the individual loads $\mathbf{5}_1$-$\mathbf{5}_n$ with different circuit topologies.

Referring to FIG. 5, the relay includes a mechanical switch 51 connected between relay terminals 52, 53. This mechanical switch 51 may serve to switch a load Z in a load circuit that can be connected to the relay terminals 52, 53. For illustration purposes, the mechanical switch 51 of FIG. 5 is drawn to be an on-off switch. However, other types of mechanical switches, such as crossover switches, can be used as well.

Referring to FIG. 5, the relay 5 further includes a coil 54 configured to switch the mechanical switch 51. The coil 54 is configured to generate a magnetic field, wherein the coil 54 switches the mechanical switch 51 in a first position (such as an on-position) when there is a magnetic field generated by the coil 54, and switches the mechanical switch 51 in a second position (such as an off-position) when there is no magnetic field generated by the coil 54 or when the magnetic field is below a value that is required to keep the switch in a closed position. The generation of the magnetic field by the coil 54 is dependent on a current I54 through the coil 54. In general, there is no magnetic field generated by the coil 54 when the current I54 is zero, and there is a magnetic field generated by the coil 54 when the current I54 is other than zero. In order to safely activate the mechanical switch 51, that is to switch the mechanical switch 51 in a first position, a first current level (magnitude) of the current I54 is required, while a second current level lower than the first current level of the current I54 is sufficient to hold the mechanical switch 51 in the first position after the switch 51 has been activated. The first level of the current I54 will be referred to as activation level, and the second level will be referred to as hold level in the following.

The coil 54 is connected in a drive current path of the relay 5. In FIG. 5, a resistor 55 connected in series with the coil 54 represents the ohmic resistance of the coil 54. In the circuit arrangements of FIGS. 1 and 4, when the individual loads $\mathbf{5}_1$-$\mathbf{5}_n$, include relays, drive current paths including the coils of the individual relays are connected in series between the load terminals 11, 12.

FIG. 5 further illustrates one embodiment of a drive unit 2 (wherein reference character 2 denotes an arbitrary one of the drive units $\mathbf{2}_1$-$\mathbf{2}_m$ as explained before). Referring to FIG. 5, the drive unit 2 includes a bypass current path connected in parallel with the drive current path of the relay 5. The bypass current path of FIG. 5 includes a switching element 21 that is driven dependent on a control signal S received by the drive unit 2 (reference character S corresponds to one of the drive signals $S_1$-$S_m$ of FIGS. 1 and 4). The switching element 21 can be implemented as a conventional electronic switch, such as a transistor. Optionally, a driver 22 receives the control signal S and generates a drive signal suitable to drive the switch 21 dependent on the control signal S. The drive unit 2 is in the high-ohmic state when the switching element 21 is switched off, and is in the low-ohmic state when the switching element 21 is switched on. The current I54 through the coil 54 is either substantially zero, namely when the drive unit 2 is in the low-ohmic state, or substantially corresponds to the load current I3, namely when the drive unit 2 is in the high-ohmic state. Thus, when the control signal S has an activation level, the switching element 21 is switched off and the load current I3 flows through the drive current path of the relay 5 in order to activate the relay 5. When the control signal S has the deactivation level, the switching element 21 is switched on, so that the switching element 21 bypasses the drive current path of the relay 5 in order to deactivate the relay.

Figure 6:
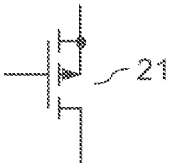
FIG. 6 illustrates one embodiment of a switch implemented in the drive unit.

Referring to FIG. 6, the switching element 21 can be implemented as a MOSFET. In the embodiment of FIG. 5, the switching element 21 is implemented as a p-type enhancement MOSFET. However, this is only an example. The MOSFET could also be implemented as an n-type enhancement MOSFET, as an n-type depletion MOSFET, or as a p-type depletion MOSFET. Any other type of transistor, such as an IGBT (Insulated Gate Bipolar Transistor), a Junction Field Effect Transistor (JFET), or a Bipolar Junction Transistor (BJT) could be used as well. Optionally, a voltage limiting element, such as Zener diode, can be connected between the gate terminal and the source terminal of the MOSFET 21 in order to limit the gate-source voltage.

Figure 7:
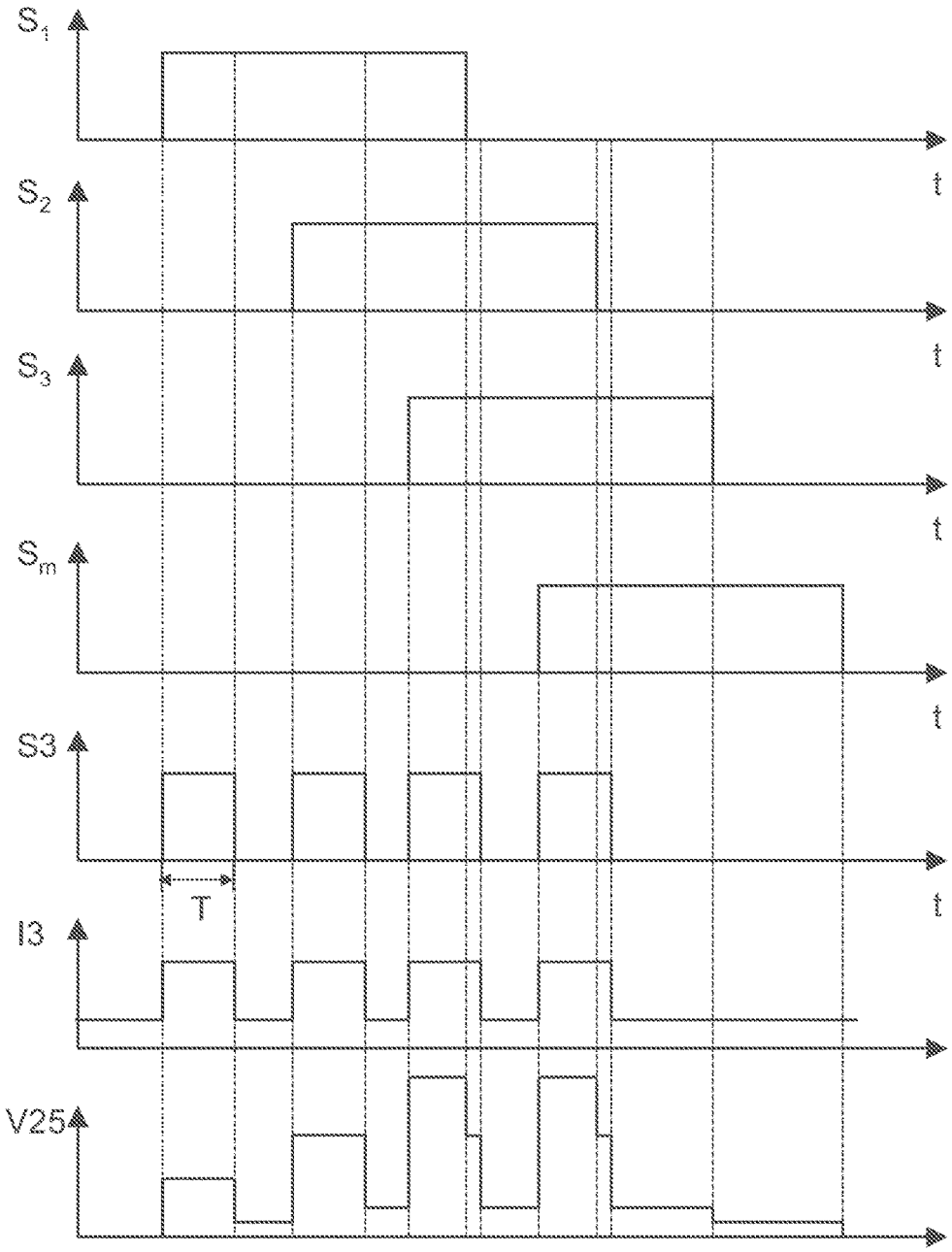
FIG. 7 shows timing diagrams illustrating the operating principle of one of the circuit arrangements of FIGS. 1 and 4.

The operating principle of the circuit arrangements of FIGS. 1 and 4 is explained with reference to timing diagrams illustrated in FIG. 7 below. FIG. 7 shows exemplary timing diagrams of the control signals $S_1$-$S_m$, of the current source control signal S3, the load current I3 and a voltage V25 across the circuit with the loads $\mathbf{5}_1$-$\mathbf{5}_n$ and the drive units $\mathbf{2}_1$-$\mathbf{2}_m$. For explanation purposes, it is assumed that an activation level of one drive signal is a high level, while a deactivation level of the drive signal is low level. Referring to the explanation before, the activation level of one drive signal drives the corresponding drive unit into an high-ohmic state and activates the corresponding load. Further, it is assumed that a signal level of the current source control signal S3 that causes the current source to generate the load current I3 with an activation level is a high signal level, while a signal level of the current source control signal S3 that causes the current source I3 to generate the load current I3 with the hold level is a low signal level.

Referring to FIG. 7, the control circuit 4 generates an activation level of the current source control signal S3 for a predefined time period T each time one of the control signals $S_1$-$S_m$ changes from the deactivation level to the activation level. Consequently, the load current I3 has an activation level for the predefined time period T each time one of the control signals $S_1$-$S_m$ changes from the deactivation level to the activation level.

The voltage V25 is dependent on the load current I3 and the number of loads that are activated. The voltage V25 increases for the predefined time period T each time, the current I3 assumes the activation level. When the load current I3 has the hold level, the voltage V25 decreases to a lower level proportional to the number of loads $\mathbf{5}_1$-$\mathbf{5}_n$, that are activated, wherein the voltage across one load is substantially proportional to the resistance (represented by resistor 55 in FIG. 5) of the coil 54 in the drive current path.

The overall power consumption of the circuit arrangement is substantially given by the supply voltage V1 multiplied with the load current I3, that is:

$$P = V1 \cdot I3 \quad (1),$$

where P is the power consumption. The power consumption P temporarily increases when the load current I3 assumes the activation level. When the load current I3 has the hold level, the power consumption is independent of the number of loads that are activated. The overall power consumption of a circuit arrangement with n loads and a supply voltage V1 is approximately n times lower than the overall power consumption of n circuit arrangements that each include only one load and that have the same supply voltage V1.

Figure 8:
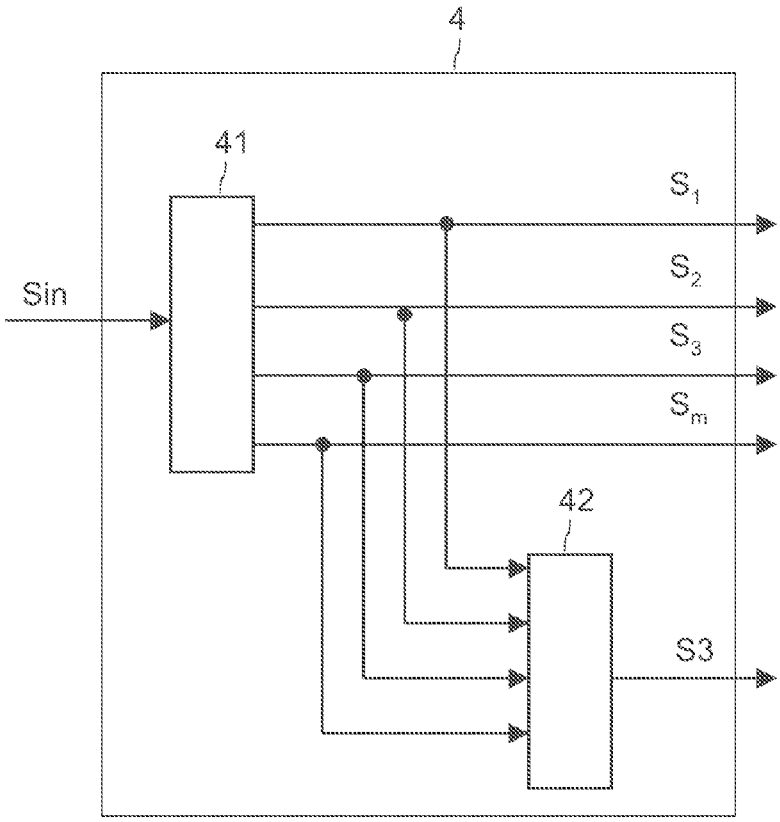
FIG. 8 illustrates one embodiment of a control circuit of FIG. 4.

FIG. 8 shows one embodiment of the control circuit 4. In this embodiment, the control circuit 4 includes an interface circuit 41 that receives the input signal Sin and that generates the control signals $S_1$-$S_m$ from the input signal Sin. The control circuit 4 further includes a current source control circuit 42 that receives the individual control signals $S_1$-$S_m$ and that is configured to generate the current source control signal S3 dependent on the individual drive signals $S_1$-$S_m$. Referring to FIG. 8, the current source control circuit 42 is configured to generate the activation level of the current source signal for the predefined time period T each time the signal level of one of the control signals $S_1$-$S_m$ changes from the deactivation level to the activation level. If two or more of the control signals $S_1$-$S_m$ change from the deactivation level to the activation level within a time window shorter than the predefined time period T, then the current source control signal S3 keeps the activation level until the time when the last one of the two or more control signals changes to the activation level plus the predefined time period.

Figure 9:
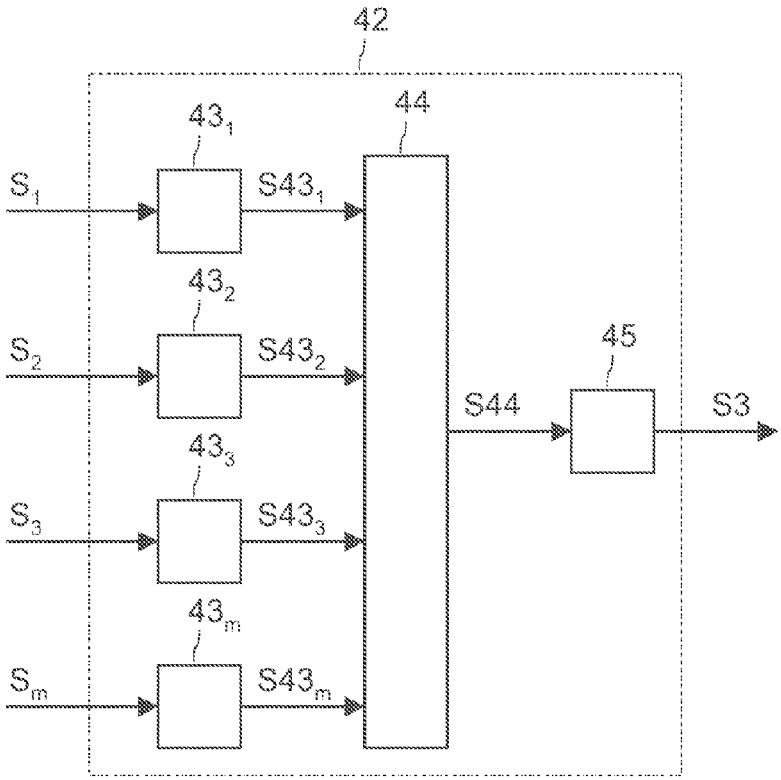
FIG. 9 illustrates one embodiment of a current source control circuit in the control circuit of FIG. 8.

One embodiment of a current source control circuit 42 that generates the current source control signal S3 from the control signals $S_1$-$\mathbf{2}_m$ is illustrated in FIG. 9. This logic circuit includes a plurality of pulse generator $\mathbf{43}_1$-$\mathbf{43}_m$ that each receives one of the control signals $S_1$-$S_m$. Each of the pulse generators $\mathbf{43}_1$-$\mathbf{43}_m$ is configured to output a pulse signal S$\mathbf{43}_1$-S$\mathbf{43}_m$ that includes a signal pulse each time the corresponding control signal $S_1$-$S_m$ changes from the deactivation level to the activation level. The pulse signals S$\mathbf{43}_1$-S$\mathbf{43}_m$ are received by a logic gate 44 that generates one pulse signal S44 from the plurality of pulse signals S$\mathbf{43}_i$-S$\mathbf{43}_m$. An output signal S44 of the logic gate has a signal pulse each time one of the input pulse signals S$\mathbf{43}_1$-S$\mathbf{43}_m$ has a signal pulse, that is each time one of the control signals $S_1$-$S_m$ changes from the deactivation level to the activation level. According to one embodiment, the logic gate 44 is a logical OR-gate.

Figure 10:
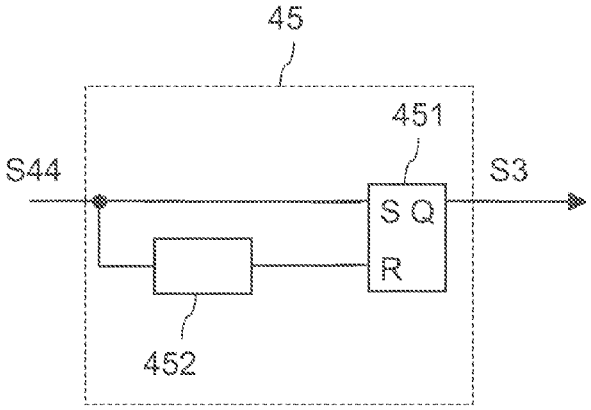
FIG. 10 illustrates one circuit block of the control circuit of FIG. 9 in greater detail.

Referring to FIG. 9, a signal generator 45 receives the pulse signal S44 output by the logic gate 44 and is configured to generate the current source control signal S3. This signal generator is configured to generate an activation level of the current source control signal S3 each time a pulse of the pulse signal S44 occurs. One embodiment of the signal generator 45 is illustrated in FIG. 10. The signal generator of FIG. 10 includes a latch, such as an SR-flip-flop 451, and a delay element 452. A set input S of the flip-flop 451 receives the pulse signal S44, so that the flip-flop 451 is set each time pulse signal S44 includes a signal pulse. A current source control signal S3 is available at an output Q of the flip-flop 451, wherein the current source control signal S3 has the activation level each time flip-flop 451 has been set. According to one embodiment, the activation level corresponds to a logical high level of the current source control signal S3.

Referring to FIG. 10, the delay element 452 also receives the pulse signal S44, the delay element 452 is configured to delay a signal pulse received at an input for the predefined time period T and to output the delayed signal pulse to a reset input R of the flip-flop 451. Thus, unless two signal pulses occur within the predefined time period T, the flip-flop 451 is reset after the predefined time period T causing the current source control signal S3 to assume the hold level, which, according to one embodiment, is a logical low level of the current source control signal S3.

Figure 11:
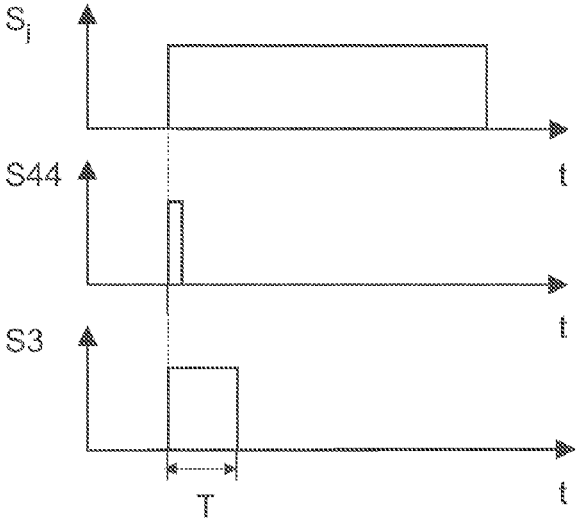
FIG. 11 shows timing diagrams illustrating the operating principle of the current source control circuit of FIG. 9.

The operating principle of the signal generator 45 of FIG. 10 is illustrated in FIG. 11. FIG. 11 shows timing diagrams of the pulse signal S44, an output signal 452 of the delay element 452 and of the current source control signal S3. Referring to FIG. 11, the current source control signal S3 assumes the activation level when a signal pulse of the pulse signal S44 occurs and assumes the hold level after the predefined time period T when the delayed signal pulse is output by the delay element 452.

Figure 12:
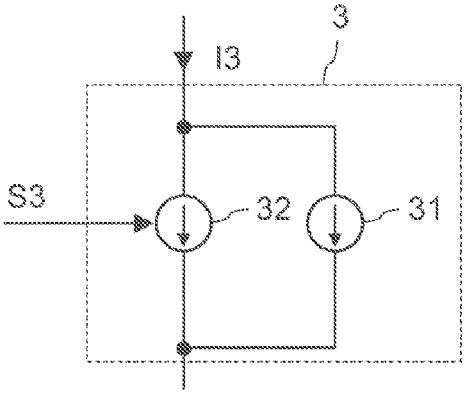
FIG. 12 illustrates a first embodiment of the current source circuit.

FIG. 12 illustrates one embodiment of the current source circuit 3. In this embodiment, the current source circuit 3 includes two current sources, namely a first current source 31 and a second current source 32. These first and second current sources 31, 32 are connected in parallel. The first current source 31 is a permanent current source, while the second current source 32 is activated and deactivated dependent on the current source control signal S3. The current source control signal S3 activates the second current source 32 when the current source control signal S3 has the activation level, and deactivates the second current source 32 when the current source control signal S3 has the hold level. The load current I3 is the sum of a first current I31 provided by the first current source 31 and a second current I32 provided by the second current source 32, wherein the second current I32 is zero when the second current source 32 is deactivated and is other than zero when the second current source 32 is activated. The hold level of the load current I3 corresponds to the level of the first current I31, while the activation level corresponds to the level of the first current I31 plus the level of the second current I32 when the second current source 32 is activated.

Figure 13:
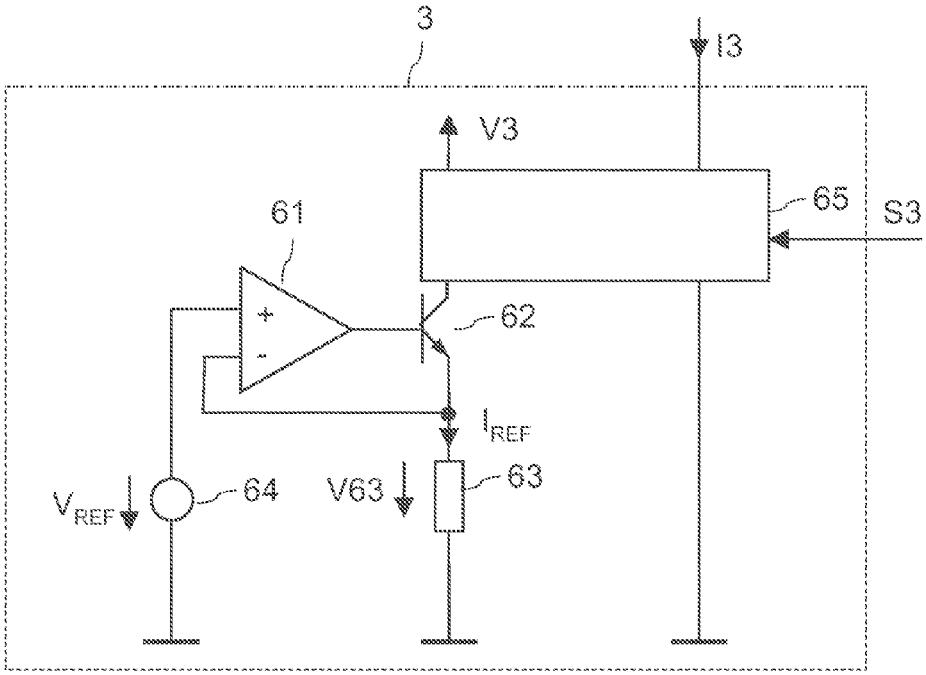
FIG. 13 illustrates a further embodiment of the current source circuit.

FIG. 13 illustrates a second embodiment of the current source circuit 3. In this embodiment, the current source circuit 3 includes a reference current source that is configured to generate a reference current $I_{REF}$. This reference current source includes a variable resistor 62, such as a transistor, and a reference resistor 63 connected in series between a supply potential V3 and a reference potential, such as ground GND. An operational amplifier 61 controls the controllable resistor 62 such that a voltage V63 across the reference resistor 63 corresponds to a reference voltage $V_{REF}$ generated by a reference voltage source 64. The reference current $I_{REF}$ is then given by the ratio $V_{REF}$/R63, wherein R63 denotes the resistance of the reference resistor.

Referring to FIG. 13, the current source circuit 3 further includes a controllable current mirror 65 that receives a reference current $I_{REF}$ and that generates the load current I3 proportional to the reference current $I_{REF}$. A proportionality factor between the reference current $I_{REF}$ and the load current I3 is dependent on the current source control signal S3, so that the load current I3 dependent on the current source control signal S3 either assumes the activation level or the hold level.

Figure 14:
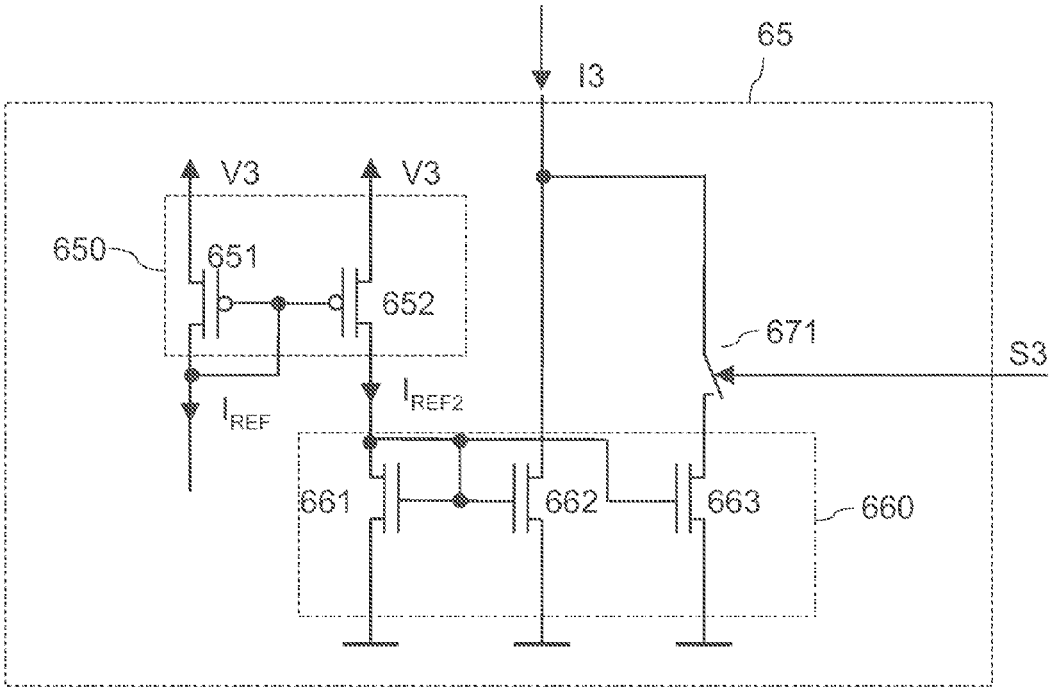
FIG. 14 illustrates a controllable current mirror of the current source of FIG. 13 in greater detail.

One embodiment of a current mirror 65 that is controllable dependent on the current source control signal S3 is illustrated in FIG. 14. This current mirror circuit includes a first current mirror 650 receiving the reference current $I_{REF}$ outputting second reference current $I_{REF2}$ to a second current mirror 660. The second reference current $I_{REF2}$ is proportional to the reference current $I_{REF}$. The proportionality factor between these reference currents $I_{REF}$, $I_{REF2}$ is one or can be different from one. This proportionality factor is dependent on a ratio between a size of a first current mirror transistor 651 and a second current mirror transistor 652 of the first current mirror 650, wherein the first transistor 651 receives the reference current $I_{REF}$ and the second transistor 652 outputs the second reference current $I_{REF2}$.

The second current mirror 660 generates the load current I3 to be proportional to the second reference current $I_{REF2}$. The second current mirror 660 includes an input transistor 661 receiving the second reference current $I_{REF2}$ and includes two output branches connected in parallel. Each of the output branches includes an output transistor 662, 663 coupled to the input transistor 661 of the second current mirror 660. The second output branch with the second output transistor 663 can be activated and deactivated. This is schematically illustrated by a switch 671 connected in series with the second output transistor 663. A current through the first output branch (through the first output transistor 662) is proportional to the second reference current $I_{REF2}$, and the current through the second output branch is zero when the second output branch is deactivated and is a current that is also proportional to the second reference current $I_{REF2}$. The current through the first output branch defines the hold level of the load current I3, and the activation level corresponds to the current through the first output branch plus the current through the second output branch when the second output branch is activated. The proportionality factor between the current through the first branch and the second reference current $I_{REF2}$ can be different from the proportionality factor between the current through the second branch and the second reference current $I_{REF2}$.

In each of the embodiments before, a ratio between the activation level and the hold level of the load current I3 is, e.g., between 2 and 10, in particular between 3 and 5.

In the description hereinbefore, directional terminology, such as "top," "bottom," "front," "back," "leading," "trailing" etc., is used with reference to the orientation of the figures being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Although various exemplary embodiments of the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. It should be mentioned that features explained with reference to a specific figure may be combined with features of other figures, even in those cases in which this has not explicitly been mentioned. Further, the methods of the invention may be achieved in either all software implementations, using the appropriate processor instructions, or in hybrid implementations that utilize a combination of hardware logic and software logic to achieve the same results. Such modifications to the inventive concept are intended to be covered by the appended claims.

Spatially relative terms such as "under," "below," "lower," "over," "upper" and the like, are used for ease of description to explain the positioning of one element relative to a second element. These terms are intended to encompass different orientations of the device in addition to different orientations than those depicted in the figures. Further, terms such as "first," "second" and the like, are also used to describe various elements, regions, sections, etc. and are also not intended to be limiting. Like terms refer to like elements throughout the description.

As used herein, the terms "having," "containing," "including," "comprising" and the like are open ended terms that indicate the presence of stated elements or features, but do not preclude additional elements or features. The articles "a," "an" and "the" are intended to include the plural as well as the singular, unless the context clearly indicates otherwise.

With the above range of variations and applications in mind, it should be understood that the present invention is not limited by the foregoing description, nor is it limited by the accompanying drawings. Instead, the present invention is limited only by the following claims and their legal equivalents.

It is to be understood that the features of the various embodiments described herein may be combined with each other, unless specifically noted otherwise.

What is claimed is:

1. A circuit arrangement, comprising:

a first number of loads coupled in series;

a second number of drive units, wherein each of the second number of drive units is coupled to at least one of the first number of loads, and is configured to receive a corresponding drive signal and to assume one of a first operation state and a second operation state dependent on the corresponding drive signal;

a current source circuit coupled in series with the first number of loads and configured to generate a variable load current such that the load current comprises a first level provided to all of the first number of loads coupled in series for a predefined time period each time any one of the second number of drive units assumes the first operation state; and a current control circuit configured to receive the corresponding drive signal from each one of the drive units, the current control circuit configured to control the current source circuit to provide the first level for the predefined time period when the drive signal received by any one of the drive units has an activation level and configured to control the current source circuit to provide a second level following the predefined time period, the second level being lower than the first level.

2. The circuit arrangement of claim 1, wherein the current source circuit comprises:

a first current source; and a second current source coupled in parallel with the first current source, wherein the second current source is configured to be activated and deactivated.

3. The circuit arrangement of claim 1, wherein the current source circuit comprises:

a reference current source configured to output a reference current; and a controllable current mirror configured to receive the reference current and to output the load current such that a proportionality factor between the reference current and the load current is dependent on a current source control signal, wherein the current source control signal is dependent on an operation state of the second number of drive units.

4. The circuit arrangement of claim 1, wherein the first number is the same as the second number.

5. The circuit arrangement of claim 1, wherein the second number is less than the first number; and wherein at least one of the second number of drive units is coupled to at least two of the first number of loads.

6. The circuit arrangement of claim 1, wherein each of the first number of loads comprises a relay comprising an actuation current path, wherein the actuation current paths of the first number of loads are coupled in series.

7. The circuit arrangement of claim 1, wherein each of the second number of drive units comprises a bypass current path coupled in parallel with the at least one of the first number of loads, wherein the bypass current path is configured to assume a high-ohmic state when a corresponding drive unit is in the first operation state and a low-ohmic state when a corresponding drive unit is in the second operation state.

8. The circuit arrangement of claim 7, wherein each of the second number of drive units further comprises a switch in the bypass current path.

9. The circuit arrangement of claim 8, wherein the switch comprises a transistor.

10. The circuit arrangement of claim 8, wherein the switch comprises a transistor selected from the group consisting of an NMOS transistor, a PMOS transistor, an NPN transistor, and a PNP transistor.

11. The circuit arrangement of claim 1, wherein the current source circuit is configured to be deactivated when none of the second number of drive units is operated in the first operation state.

12. A drive circuit, comprising:

a number of drive units, wherein each of the drive units is configured to be coupled to at least one load, to receive a corresponding drive signal, and to assume one of a first operation state and a second operation state dependent on the corresponding drive signal;

a current source circuit configured to be coupled in series with each of the at least one load and configured to generate a variable load current such that the load current comprises a first level provided to each of the at least one load for a predefined time period each time one of the drive units assumes the first operation state; and a current control circuit configured to receive the drive signal from each one of the drive units, the current control circuit configured to control the current source circuit to provide the first level for the predefined time period when the drive signal received by any one of the drive units has an activation level and configured to control the current source circuit to provide a second level following the predefined time period, the second level being lower than the first level.

13. The drive circuit of claim 12, wherein each of the number of drive units is coupled to one load.

14. The drive circuit of claim 12, wherein each of the drive units comprises a bypass current path configured to be connected in parallel with the at least one load, wherein the bypass current path is configured to assume a high-ohmic state when a corresponding drive unit is in the first operation state and a low-ohmic state when the corresponding drive unit is in the second operation state.

15. The drive circuit of claim 14, wherein each of the drive units further comprises a switch in the bypass current path.

16. The drive circuit of claim 15, wherein the switch comprises a transistor.

17. The drive circuit of claim 15, wherein the switch comprises a transistor selected from the group consisting of an NMOS transistor, a PMOS transistor, an NPN transistor, and a PNP transistor.

18. The drive circuit of claim 12, wherein the current source circuit comprises:

a first current source; and a second current source coupled in parallel with the first current source, wherein the second current source is configured to be activated and deactivated.

19. The drive circuit of claim 12, wherein the current source circuit comprises:

a reference current source configured to output a reference current; and a controllable current mirror configured to receive the reference current and to output the load current such that a proportionality factor between the reference current and the load current is dependent on a current source control signal, wherein the current source control signal is dependent on the operation states of the drive units.

20. The drive circuit of claim 12, wherein the current control circuit is further configured to control the current source to provide the first level beyond the predefined time period when the drive signal received by another of the drive units has the activation level while the first level is being provided by the current source.

21. A circuit arrangement, comprising:

a first number of loads coupled in series;

a second number of drive units, wherein each of the second number of drive units is coupled to at least one of the first number of loads, and is configured to receive a corresponding drive signal and to assume one of a first operation state and a second operation state dependent on the corresponding drive signal;

a current source circuit coupled in series with the first number of loads and configured to generate a variable load current such that the load current comprises a first level provided to all of the first number of loads coupled in series for a predefined time period each time any one of the second number of drive units assumes the first operation state;

a reference current source configured to output a reference current; and a controllable current mirror configured to receive the reference current and to output the load current such that a proportionality factor between the reference current and the load current is dependent on a current source control signal, the current source control signal being dependent on an operation state of the second number of drive units, wherein the controllable current mirror comprises a first current mirror and a second current mirror, the second current mirror having a first output branch and a second output branch, wherein the second output branch is configured to be activated or deactivated dependent on the current source control signal, wherein the second output branch is activated when the load current comprises the first level.

* * * * *